United States Patent [19]

Darlington

[11] Patent Number: 4,524,750

[45] Date of Patent: Jun. 25, 1985

[54] ARCHERY BOW AND CABLE POSITIONER

[75] Inventor: Rex F. Darlington, Hale, Mich.

[73] Assignee: Container Specialties, Inc. (by Kleman), Flint, Mich.

[21] Appl. No.: 474,203

[22] Filed: Mar. 10, 1983

[51] Int. Cl.[3] ..... F41B 5/00

[52] U.S. Cl. ..... 124/23 R; 124/90

[58] Field of Search ..... 124/23 R, 24 R, DIG. 1, 124/90, 91; 24/49 S, 115 M

[56] References Cited

U.S. PATENT DOCUMENTS 3,675,277 7/1972 Day ..... 24/49 S 4,300,521 11/1981 Schmitt ..... 124/23 R

OTHER PUBLICATIONS

"York's New Excalibre"–Bow and Arrow, Jun. 1982, pp. 20 & 23.

*Primary Examiner*—Richard J. Apley

*Assistant Examiner*—William R. Browne

*Attorney, Agent, or Firm*—Barnes, Kisselle, Raisch, Choate, Whittemore & Hulbert

[57] ABSTRACT

A compound archery bow with a bowstring and coincident cable return runs in connection with an overcenter pulley at opposite bow limbs. A cable positioner adjacent the extremity of each bow limb embraces the cable return runs and prevents bowstring and cable interference in the operation of the bow.

3 Claims, 3 Drawing Figures

FIG.1
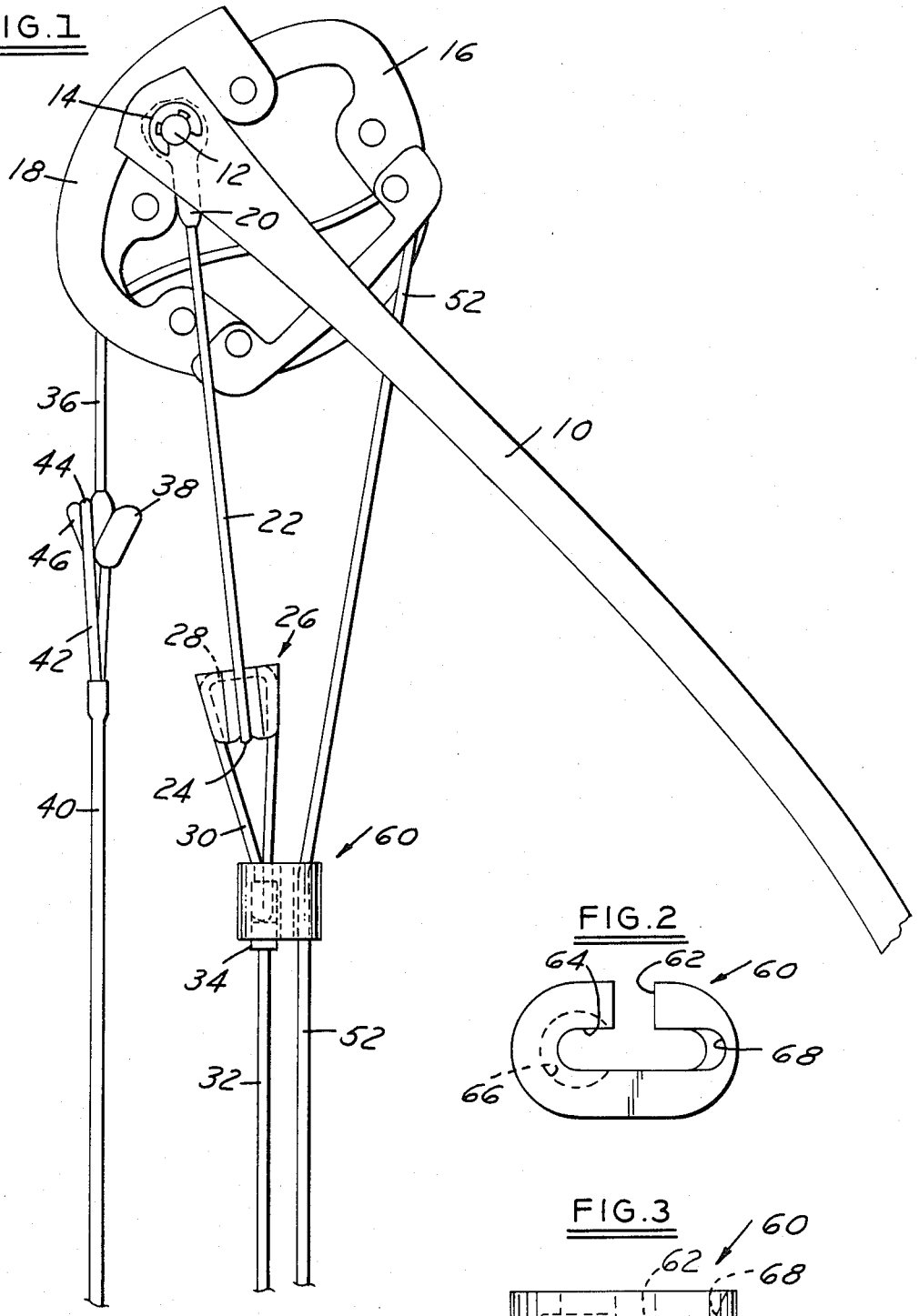
FIG.2
FIG.3
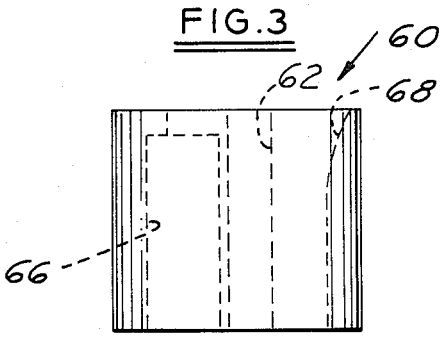

ARCHERY BOW AND CABLE POSITIONER

FIELD OF INVENTION

Archery bows of the compound type wherein the draw force diminishes beyond a certain point to ease the tension on the archer's draw arm.

BACKGROUND OF INVENTION

Archery bows, in recent years, since the advent of the Allen U.S. Pat. No. 3,486,495 (Dec. 30, 1969), have been designed to incorporate the principle reformed as a compound bow. This type of bow has an overcenter action which, at a certain point in the draw stroke, reduces the pull required by the archer. Thus, the diminished pull makes it easier for the bowman to steady the arrow and bow and perfect his aim before releasing the arrow. The stored energy is not reduced in this type of bow action.

However, as illustrated in the above-referenced Allen patent and also in U.S. Pat. No. 4,338,910, issued July 13, 1982, the structure required for the compound bow departs from the single bowstring and requires additional strings usually referenced as cables extending between the opposed links of the bow.

These cables are in a rather close relationship and must be so positioned that there is no interference with the bowstring or arrow upon release.

The present invention is directed to a cable positioner which will guide the return cables in such a way that the bowstring is always clear of the extra cables and there is no arrow intereference upon release.

It is, therefore, an object of this invention to provide a cable guide and positioner which is inexpensive and yet so located that it will perform the function of controlling the bow return cables to avoid contact with adjacent components of the bow assembly. This provides a quieter arrow release and prevents wear on the bowstring and cables previously resulting from contact on release.

It is, therefore, an object of the invention to provide a cable positioner which is easily positioned and assembled on a compound bow.

Other objects and features of the invention will be apparent in the following description and claims in which the principles of the invention are set forth together with details to enable those skilled in the art to practice the invention, all in connection with the best mode presently contemplated for the invention.

BRIEF DESCRIPTION OF THE DRAWINGS

Drawings accompany the disclosure and the various views thereof may be briefly described as:

FIG. 1, an elevation of one end of a bow limb illustrating the functioning components.

FIG. 2, an end view of a cable positioner.

FIG. 3, a side elevation of the cable positioner.

DETAILED DESCRIPTION OF INVENTION AND THE MANNER AND PROCESS OF USING IT

With reference to the drawings, a top bow limb 10 is illustrated with the various components of the compound bow. The bottom bow limb would be essentially identical and is not illustrated.

The bow limb 10 is preferably a bifurcate limb at the distal end, the spaced portions being transfixed by an axle pin 12 held in place by spring retainers 14 at each end. The axle pin 12 is the axis of rotation of an eccentric double pulley functionally similar to that shown in the above-referenced U.S. Pat. No. 4,338,910. Two pulley sections 16 and 18 are axially spaced from each other but they turn as a unit.

On each side of the pulley unit are anchor loops 20 mounted on the axle pin 12, each securing an end of a an anchor cable loop 22 which at its bight 24 captures an anchor harness assembly 26 which has one U-shaped groove to receive the bight 24 and a second U-shaped groove at 90° to the first to receive the bight 28 of a loop 30 formed at the end of cable return 32. The short end of loop 30 is captured against the cable 32 by a cable crimp 34 which is common in the industry.

The pulley assembly 16–18 may be a double pulley or a triple pulley. The far pulley as viewed in FIG. 1 will carry the bowstring anchor length 36 which wraps around and is anchored in the far pulley. A cable slug 38 has a center projection securely attached to the anchor length 36. The top end of the bowstring 40 has a loop 42, the bight 44 of which is captured in a side lug 46 of the slug 38. This same construction is duplicated at the lower limb of the bow.

A second return cable 52 wraps at the upper end of a near pulley of the assembly so that there is an axial spacing of length 36 and return cable 52. The lower end of cable 52 will be attached to an anchor harness 26 at the lower limb. Similarly, the lower end of return cable 32 will wrap around a corresponding pulley at the lower limb in the same manner as cable 52 at the top end.

The cable positioner of the present invention is illustrated at 60 in FIGS. 1, 2 and 3. It consists of a C-shaped element of metal or dense, smooth plastic which is essentially an oval cylinder with a side slot 62 opening to a rectangular axial recess 64 rounded at the ends. The left-hand end of the axial recess 64 is enlarged at 66 to receive the cable crimp 34. The right-hand end is curved outwardly at 68 to accommodate the cable 52 at bends off to the pulley assembly.

The cable positioner 60 is easily applied to cables 32 and 52 by passing the doubled end of loop 30 at the anchored end through the slot 62 above the cable crimp 34 and then moving the positioner down over the cable O-rings 34 which will enter and lodge securely in the opening 66. The cable 52 is then moved through the slot 62 where it will be captured in a sliding relationship and be retained by the tension of the cables. The cable 52 may slide freely in the positioner as the bowstring is drawn and released. The crimp 34 is locked into the recess 66 in a manner to prevent sliding.

Thus, the cable positioner at each end will confine the cables 32 and 52 in close proximity and the cable 52 is held away from contact with the bow limb when an arrow is released after draw. By holding the cables 32 and 52 in the confined position illustrated, the operation of the bow is quieter and the components are not subject to wear caused by repeated contact during the operation of the bow.

What is claimed is:

1. In a compound bow assembly of the type having eccentrically mounted pulleys at each bow limb, a bowstring and a pair of return cables, said pair of return cables including first and second return cables, each return cable anchored respectively at opposite bow limbs and each passing from the anchored end to a pulley at the end opposite to the anchored end, that improvement which comprises:

a cable positioner at each end of the bow having a securing portion and a guiding portion, said securing portion being secured adjacent the anchored end of a first return cable, and said guiding portion having a slide passage to receive a second return cable at an end opposite to that at which it is anchored and to retain said second return cable in close proximity to said first return cable, said positioners serving to maintain said first and second cables in a close relatively parallel relation during the operation of the bow.

2. A compound bow assembly as defined in claim 1 in which said first return cable has a cable crimp to provide an anchor loop adjacent the anchored end of the first cable, and said cable positioner has an axial recess in said securing portion to receive and lineally engage said cable crimp to retain said positioner in a predetermined lineal location on said first return cable.

3. A compound bow assembly as defined in claim 1 in which each of said cable positioner comprises an oval cylindrical element having a rectangular axial recess, one side of said recess having an opening to receive and axially engage a first return cable, and the other side of said recess having an axial slide passage for said second return cable, said element having an axial side passage to provide lateral ingress of said cables into said axial recess assembly.

* * * * *

UNITED STATES PATENT AND TRADEMARK OFFICE

CERTIFICATE OF CORRECTION

PATENT NO. : 4,524,750

DATED : June 25, 1985

INVENTOR(S) : Rex F. Darlington, et al

It is certified that error appears in the above-identified patent and that said Letters Patent is hereby corrected as shown below:

On the title page, Item (75) add: --John Kleman, Hale Mich.--.

Signed and Sealed this

*Twenty-fourth* Day of *September 1985*

[SEAL]

*Attest:*

DONALD J. QUIGG

*Attesting Officer*

*Commissioner of Patents and Trademarks—Designate*